United States Patent [19]

Gebelius

[11] Patent Number: 4,617,768

[45] Date of Patent: Oct. 21, 1986

[54] POLESHAPED SUPPORTING MEMBER, AND BASE STRUCTURE FOR ATTACHMENT OF SAME

[76] Inventor: Sven Runo V. Gebelius, Box 15008, Bromma, Sweden, S-161 15

[21] Appl. No.: 755,334

[22] PCT Filed: Nov. 1, 1983

[86] PCT No.: PCT/SE83/00376

§ 371 Date: Jun. 20, 1985

§ 102(e) Date: Jun. 20, 1985

[87] PCT Pub. No.: WO85/01977

PCT Pub. Date: May 9, 1985

[51] Int. Cl.[4] ..... E04H 12/08

[52] U.S. Cl. ..... 52/40; 52/292; 52/726; 248/159; 362/431

[58] Field of Search ..... 52/40, 28, 292, 298, 52/726, 731, 720, 738; 362/431; 248/159

[56] References Cited

U.S. PATENT DOCUMENTS

| | | | |
|---|---|---|---|
| 1,870,770 | 8/1932 | De Witt | 52/726 |
| 2,016,011 | 10/1935 | Kent | 52/292 |
| 2,945,659 | 7/1960 | McDonald | 52/40 |
| 3,364,635 | 1/1968 | Guggemos | 52/40 X |
| 3,671,738 | 6/1972 | Beachley | 52/292 X |
| 3,974,372 | 8/1976 | Cochran | 52/731 X |

FOREIGN PATENT DOCUMENTS

| | | | |
|---|---|---|---|
| 688576 | 6/1964 | Canada | 52/726 |
| 2708664 | 9/1977 | Fed. Rep. of Germany | 52/40 |

*Primary Examiner*—J. Karl Bell

*Attorney, Agent, or Firm*—Holman & Stern

[57] ABSTRACT

A poleshaped supporting member (1) having a tubular cross-section, and a base structure (2) for attachment of same, said poleshaped member (1) having a conically tapering cross-section in direction from the ground plane, said base structure (2) including an attachment member (3) having a conicity and external shape which substantially corresponds to the internal larger portion of the poleshaped member (1). By means of at least one clamping member surrounding the poleshaped member (1), located at the portion embracing the attachment member (3), said portion can be pressed into frictional contact against the attachment member (3). At both the upper portion of the attachment member (3), and the larger portion of the poleshaped member (1), electrical connecting members (5, 6) are arranged, joined to a voltage feeding cable (4) respectively a cable (7) surrounded by the poleshaped member (1), connected to a directly or indirectly suspended electrical fitting. The connecting members (5, 6) are preferably arranged to facilitate jack connection against each other, and advantageously is a fuse means (8) arranged in an intermediate position between a first connecting member (5) located by the attachment member (3) and associated electric feed cable (4).

10 Claims, 4 Drawing Figures

1
7
9
11
10
6
8
5
3
2
4
1
9
2

1
7
14
1
9
11
10
6
13
8
5
14
3
9
2
12
12'
2
4

POLESHAPED SUPPORTING MEMBER, AND BASE STRUCTURE FOR ATTACHMENT OF SAME

CROSS REFERENCE TO RELATED APPLICATION(S)

This United States application stems from PCT International Application No. PCT/SE83/00376 filed Nov. 1, 1983.

BACKGROUND OF THE INVENTION

The present invention relates to a poleshaped supporting member, and a base structure for attachment of same, said supporting member preferably being arranged to support street light assemblies, illuminated road signs or other electrical equipment.

Previously known types of poleshaped supporting members can basically be divided into three categories, namely solid members, tubular members and members having a framework construction. With regard to both solid members and members having a framework construction, a separate and external connection box must be used to accomplish electrical connection to an electric feed cable extending below the ground level, and said connection box also includes associated electrical fuses. Furthermore, the cable joining the connection box and the electrical equipment suspended by the member is substantially totally unprotected. In order to receive protection for the last mentioned cable, and in order to avoid use of externally located connection boxes, tubular supporting members have previously been used, having an aperture located adjacent to the ground level, arranged with a detachably mounted lid. Terminal block and fuse holders can thus be arranged covered by said lid. In view of the fact that the aperture located adjacent to the ground level considerably reduces the physical properties of the tubular supporting member, a relatively large wall thickness has been required, resulting in large weight and high manufacturing cost for the member, and the members also cause considerable damage in collisions with vehicles. Certain proposed 'collision friendly' members are previously known, e.g. having fractural impressions added during manufacture, intended to make the member break if same is involved in a collision with a vehicle. Also this last mentioned type is expensive to manufacture, and installation costs are also high.

SUMMARY OF THE INVENTION

The object of the present invention is to disclose a poleshaped supporting member, which completely meets the requirements fulfilled by the above discussed previously known tubular supporting members, but which also prevents unauthorized manipulation with the terminal block and the fuse holders which are located surrounding by the member. The member further facilitates extremely simple and rapid installation, as well as electrical connection. Finally, extremely high requirements relating to safety against damage in a collision with a vehicle are also catered for, and after such an incident, a damaged member can be replaced by a new member rapidly and at a low cost.

The poleshaped supporting member according to the present invention, and the base structure for attachment of same are based on the fact that the poleshaped supporting member has a tubular cross-section, and are mainly characterised in that the poleshaped member is arranged having a conically reduced cross-section in direction from the ground plane, and that an associated base structure includes an attachment member extending in direction towards the poleshaped member having a conicity and external shape substantially corresp- ding to surrounding portion of the poleshaped member, and that at least one clamping member surrounding the poleshaped member is arranged to press the portion of the poleshaped member surrounding the attachment member into a frictional contact position against the attachment member.

BRIEF DESCRIPTION OF THE DRAWINGS

Two basic examples of embodiments according to the present invention are more fully described with reference to the accompanying drawings, in which.

DETAILED DESCRIPTION OF THE INVENTION

Figures 1, 2:
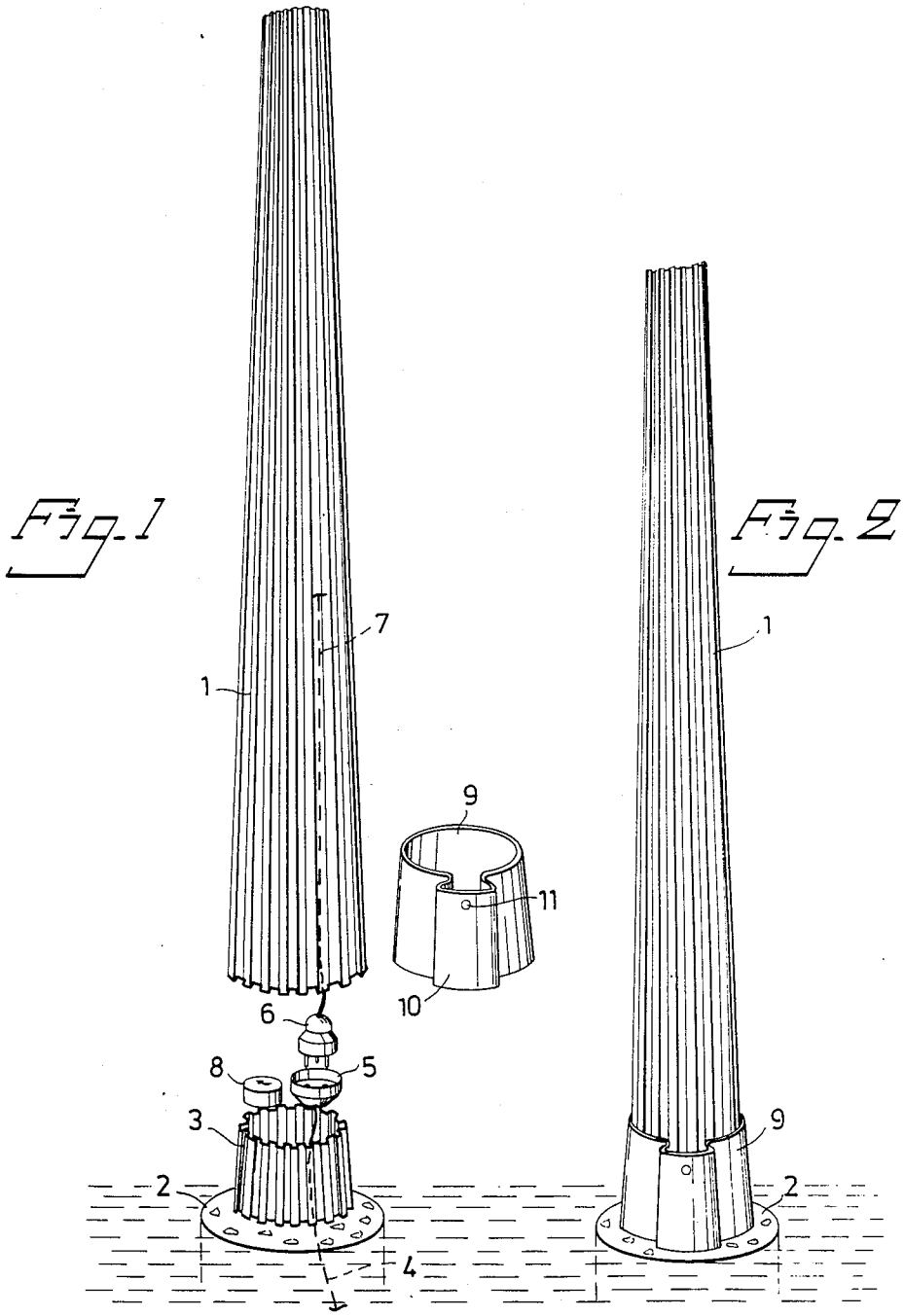
FIG. 1 shows a perspective view of a first embodiment of a poleshaped supporting member and associated base structure according to the invention, located separated from each other.
FIG. 2 shows the poleshaped member and associated base structure as shown in FIG. 1 joined together, and with a detailed view of an associated clamping member shown in an adjacent position.

With reference to the embodiment shown in FIGS. 1 and 2, a poleshaped supporting member 1 is shown as a conical tubular member, having the larger end portion located adjacent to a base structure 2. The tubular member 1 has a surrounding surface with a mainly corrugated shape, but also other shapes can obviously be used. An attachment member 3 extends from the base structure 2 in direction towards the tubular member 1, having a conical shape substantially corresponding to the adjacent end portion of the tubular member 1. FIG. 1 also shows how an electric feed cable 4 extends up through the base structure 2 and the attachment member 3, and how said feed cable 4 is terminated by means of a first electric connection member 5. A second electric connection member 6 is attached to a cable 7, extending surrounded by the tubular member 1, intended to be connected at the opposed and not shown end portion to a light fitting, suspended by the tubular member. A fuse box 8 is also shown adjacently located to the connection member 5, 6, preferably arranged to connect the feed cable 4 with the first connection member 5 in a not shown way. It should be mentioned, that the first connection member 5 and the fuse box 8 advantageously are attached against, or recessed below, the upper plane of the attachment member 3, even though same have been shown located above said plane. With regard to this embodiment, the attachment member 3 should preferably not extend more than a short distance above the ground level, preferably not exceeding a few decimeter.

When used, the base structure 2 is first attached in a conventional way, e.g. by concreting, and the feed cable 4 is attached to the first connection member 5.

The poleshaped supporting member 1 is preferably joined to intended light fitting before attachment to the base structure 2, which fitting is connected to the second connection member 6 by means of of the cable 7 enclosed within the poleshaped member 1. The poleshaped member 1 is located with the larger end portion adjacent to the base structure 2, and the first and the second connection member, 5 and 6 respectively, are plugged together. Electrical connection has thus been established, and the poleshaped supporting member is thereafter raised to a substantially vertical position, and then placed over the base structure 2, the attachment member 3 being located embraced by the poleshaped member 1.

In order to lock the poleshaped member 1 against the base structure 2, a locking member is utilized, as a complete unit denominated 9, shown in FIG. 2. Said locking member 9, which before placing the poleshaped member 1 against the base structure 2 is located surrounding the poleshaped member 1 at a distance from the large end portion of said member, comprises of a tubular member, having at least one peripheral portion arranged as a wedgeshaped part 10, formed by an embossed portion, joined to the remaining tubular member 9 by means of towards each other inclined portions. Said wedgeshaped part 10 thus forms a resilient expandable member together with the tubular member 9, thereby facilitating diametrical expansion of the tubular member 9. Furthermore, a through hole 11 is taken up in the outer portion of the wedgeshaped part 10, intended to facilitate attachment of a tool.

When the poleshaped member 1 has been located embracing the attachment member 3, the locking member 9 is slided towards the base structure 2, e.g. by impact force applied against the upper edge portion of the wedgeshaped part 10, whereby the locking member 9 takes up the position shown in FIG. 2, i.e. located adjacent to the base structure 2. Since the internal diameter of the locking member 9 is choosen smaller than the external diameter of the larger end portion of the poleshaped member 1, the last mentioned end portion is pressed against the attachment member 3, whereby the poleshaped member 1 is locked in relation to the base structure 2.

In order to remove the above described locking member 9, e.g. for maintenance operations, a special purpose tool is used, including a hook-shaped part which can be attached to the hole 11 in the wedgeshaped part 10. By application of pressure against said tool, the hook-shaped part is arranged to move away from the base structure 2, and thus move the locking member 9 to a location in which same no longer applies a pressure against the poleshaped member 1 in direction towards the attachment member 3. Since the locking member 9 in applied position usually is arranged located below the ground surface, the risk for unauthorized influence against same is small, and such influence also requires access to a specifically designed tool.

The embodiment shown in FIGS. 1 and 2 is primarily intended for applications in which the upper plane of the attachment member 3 must be located above the ground surface, in order to obtain security against penetration of ground water or rain water above said plane. However, there are a large number of applications for which such precautions are unnecessary, and an example of an embodiment for such applications is shown in FIGS. 3 and 4.

In these figures, the same method of attachment is used as described with reference to the first embodiment, but in order to remove rain water and similar, the base structure 2 has been arranged with a number of drainage holes 12, 12' in the plane from which the attachment member 3 extends (only shown in FIG. 3). From said plane of the base structure 2, a tubular member 13 also extends upwardly, against the upper plane of which a sealing collar 14, e.g. of rubber, synthetic rubber, synthetic plastic or similar, is arranged to take up contact.

In the embodiment shown in FIGS. 1 and 2, the attachment member 3 is only intended to extend a small distance above the ground surface, coparable to the tire height for conventional cars tires, i.e. usually not exceeding 300 mm. In a possible collision with a vehicle, and if said vehicle should hit the poleshaped member and associated base structure with one of the vehicle wheels, the vehicle will only suffer minor damage, since the low height of the attachment member 3 will only cause the tire of the wheel in question to be twisted off or damaged. Since the poleshaped member 1 is manufactured from fairly thin sheet metal, also a direct collision will result in extremely restricted damage to the vehicle, since the poleshaped member is bent down. Also with regard to collision in high speed, when there is a risk that the poleshaped member falls down onto a colliding vehicle, the design is extremely suitable. In this case, the poleshaped member 1 disengages from the base structure 2, and falls down behind the vehicle causing the disengagement.

Figures 3, 4:
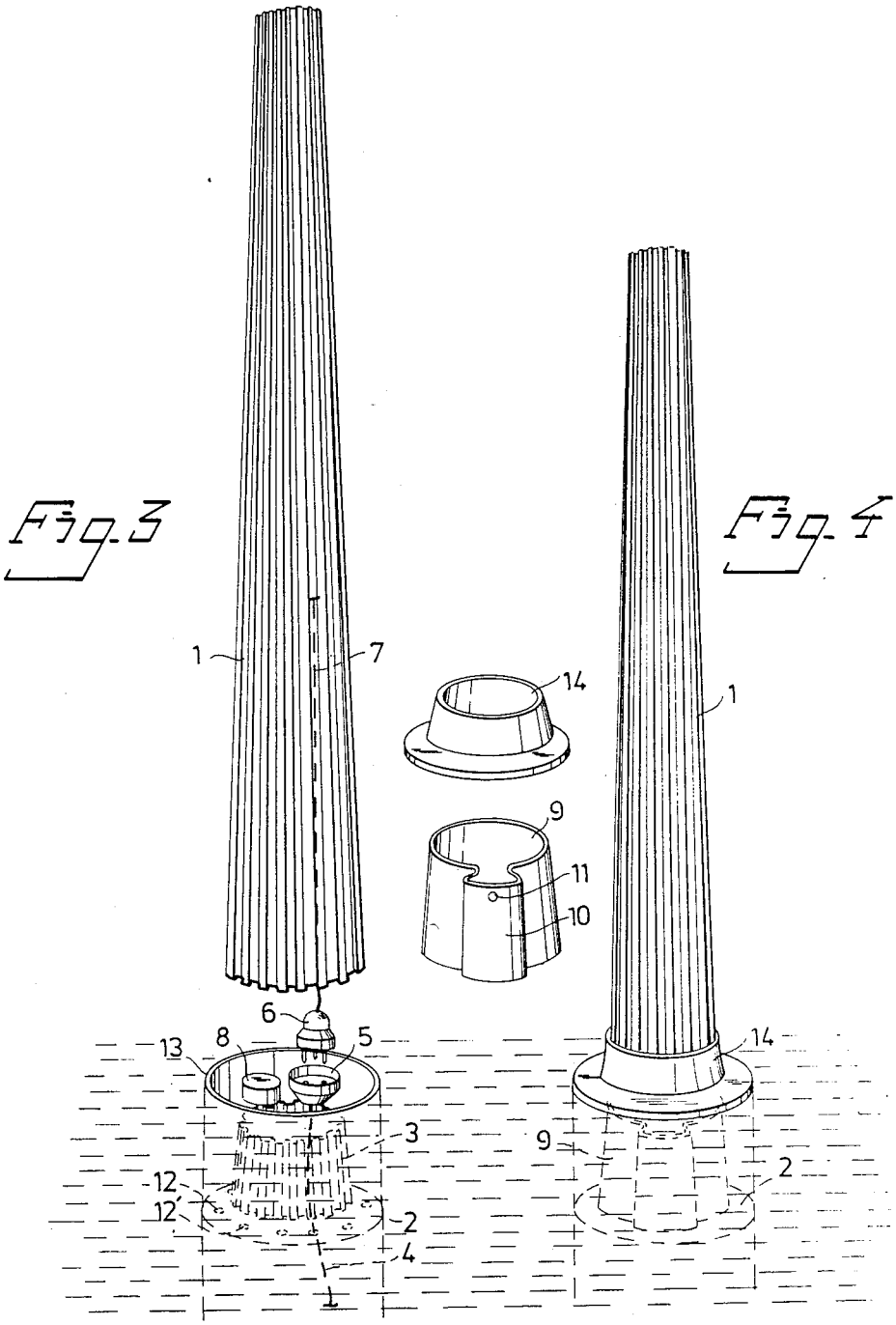
FIG. 3 shows a perspective view of a second embodiment according to the invention, with the poleshaped supporting member and the base structure located separated from each other.
FIG. 4 shows the the poleshaped supporting member and associated base structure of FIG. 3 joined together, and two associated parts shown as adjacently located detailed views.

With regard to the embodiment shown in FIGS. 3 and 4, the conditions relating to collision with vehicles are even more favourable. Since the entire attachment member 3 is located below the ground surface, damage imposed on a colliding vehicle is restricted to a minimum. In low speed collisions, the poleshaped member 1 is bent down, and it may possibly disengage from the attachment member 3. When collisions occur in high speed, the poleshaped member 1 is removed, and falls down without causing any actual damage to the colliding vehicle.

Since the poleshaped members 1 are electrically connected by means of a plug/jack connection, replacement of damaged members can be performed extremely rapid and simple. Existing connection in the attachment member 3 of the base structure 2 can basically always be regarded as undamaged, and a new poleshaped member can thus simply be electrically connected and installed in previously described fashion.

Existing electrical connections and associated fuses are also well protected against influence from unauthorized persons, as compared to previously known types where only attachment screws for a protective lid must be removed. When replacing a fuse, or similar operation, authorized persons having the previously mentioned demounting tool can easily separate the poleshaped member 1 from the base structure 2, and due to the low weight of the poleshaped member 1, same can easily be lifted during such an operation.

For certain applications, it may be desirable to strengthen the poleshaped member 1, e.g. when same is used to suspend a fitting located in a side relationship to the member 1. Strengthening can easily be accomplished to desired extent, by use of one or a number of conical tubular members, corresponding to the poleshaped member 1, which are slided into said last member 1. The length of such insertable elements can be choosen as desired, but they are preferably arranged in successively falling lengths in relation to the poleshaped member 1, and extending from the larger end portion of said member 1.

The embodiments shown and described are only intended to serve as examples of embodiments within the scope of the inventive thought and the following claims, and may obviously be further modified for various applications. For example, the locking member 9 can thus be arranged in a number of other ways, e.g. as one or a number of clamping straps, which can be arranged surrounding the portion of the poleshaped member 1 embracing the attachment member 3.

What is claimed is:

1. A support structure comprising:

a poleshaped member having a tubular cross-section, said poleshaped member having an inner surface and an outer surface;

said poleshaped member having a conically reduced cross-section in direction from a ground plane;

a base structure;

an attachment member adapted to be detachably secured to said poleshaped member;

said attachment member having an external shape substantially corresponding to said inner surface of said poleshaped member;

at least one clamping member surrounding said poleshaped member adapted to press a portion of said poleshaped memeber surrounding said attachment memeber into a frictional contact position against said attachment member;

a first electrical connection member disposed adjacent to an upper plane of said attachment member, said first electrical connection member being joined to an electric feed cable; a second electrical connecting member being disposed to a larger end portion of said poleshaped member, and being joined to a cable;

said cable being disposed within said poleshaped member;

said first and second connecting members being electrically interconnectable to supply voltage to an electric fitting suspended by said poleshaped member.

2. A support structure according to claim 1, wherein said member comprises at least one substantially tubular member, including at least one longitudinally extending wedgeshaped portion, joined by inclined portions, said tubular member having an internal diameter smaller than an external diameter of said poleshaped member at a portion thereof adapted to embrace said attachment member.

3. A support structure according to claim 1, wherein said poleshaped member has a substantially corugated cross -sectional configuration.

4. A support structure wherein said clamping member comprises at least one substantially tubular member said at least one substantially tubular member including at least one longitudinally extending wedgeshaped portion joined to a portion of said remaining tubular member by inclined portions, said tubular member having an internal diameter smaller than a coresponding external diameter of said poleshaped memeber at a portion of said poleshaped member adapted to embrace said attachment memeber.

5. A support structure according to claim 4, wherein said wedgeshaped portion is arranged has at least one through hole adapted to facilitate inter-connection with a hook-shaped part of a demounting tool for said clamping member.

6. a support structure according to claim 1, wherein said clamping member comprises at least one clamping strap, applied surrounding a portion of said poleshaped member which embraces said attachment member.

7. A support structure according to claim 1, wherein an an upper plane of said attachment member is disposed above but adjacent to a ground plane, at a distance not exceeding 50 cm from said ground plane.

8. A support structure according to claim 1, wherein an upper plane of said attachment member is disposed no higher than the plane of as ground plane.

9. A support structure according to claim 1, wherein said poleshaped member includes at least one corespondingly shaped member, located in a position surrounded by said poleshaped member, and extending in a direction from an edge portion portion at a larger end portion of said poleshaped memeber.

10. A support structure according to claim 1, wherein said poleshaped member includes at least one correspondingly shaped member which is disposed in a region surrounded by said poleshaped member, and extending in direction from larger end portion of said poleshaped member at a distance from a free edge portion at said poleshaped member not smaller than a height of said attachment member.

* * * * *